US005841147A

United States Patent [19]

Steinke et al.

[11] Patent Number: 5,841,147

[45] Date of Patent: Nov. 24, 1998

[54] INTERMODAL MODULAR SPENT NUCLEAR FUEL TRANSPORTATION SYSTEM

[75] Inventors: James E. Steinke, Smithfield; Richard K. Feamster, Jr., Gloucester; Hugh E. Thompson, Gloucester Point, all of Va.

[73] Assignee: Newport News Shipbuilding and Dry Dock Company, Newport News, Va.

[21] Appl. No.: 920,651

[22] Filed: Aug. 29, 1997

Related U.S. Application Data

[60] Provisional application No. 60/040,358, Mar. 12, 1997.

[51] Int. Cl.[6] ..... G21F 5/00

[52] U.S. Cl. ..... 250/507.1

[58] Field of Search ..... 250/507.1, 506.1, 250/505.1; 376/272

[56] References Cited

U.S. PATENT DOCUMENTS 4,893,022 1/1990 Hall et al. ..... 250/507.1

*Primary Examiner*—Kiet T. Nguyen

*Attorney, Agent, or Firm*—Lalos & Keegan

[57] ABSTRACT

The Intermodal Modular Spent Nuclear Fuel Transportation System uses standardized truck, rail, barge or ship mounted equipment to transport nuclear materials including Spent Nuclear Fuel (SNF) in standardized overpacks maximizing interchangeability of transportation components. One or more standard truck transportable SNF canisters or standard overpacks are transported in shielded, truck-mounted overpacks. SNF canisters are transferred, using a winch or other movement device, to empty positions within large rail or barge transportable overpack bundles constructed using a plurality of overpacks. An overpack bundle is supported and raised by a cradle assembly and further may be rotated horizontally right or left to allow truck docking from a direction perpendicular to the normal orientation of the rail car. The overpack bundle is axially indexed for positioning empty overpacks for loading. Transfer of standard overpack may be accomplished using a pulling or pushing device or other movement device such as a winch. The overpack bundle is disposed upon a cradle assembly and secured with tiebands. The cradle assembly is provided with rollers displaced into operative position. The overpack bundle may be raised and supported while facilitating axial rotation.

34 Claims, 14 Drawing Sheets

FIG. 4
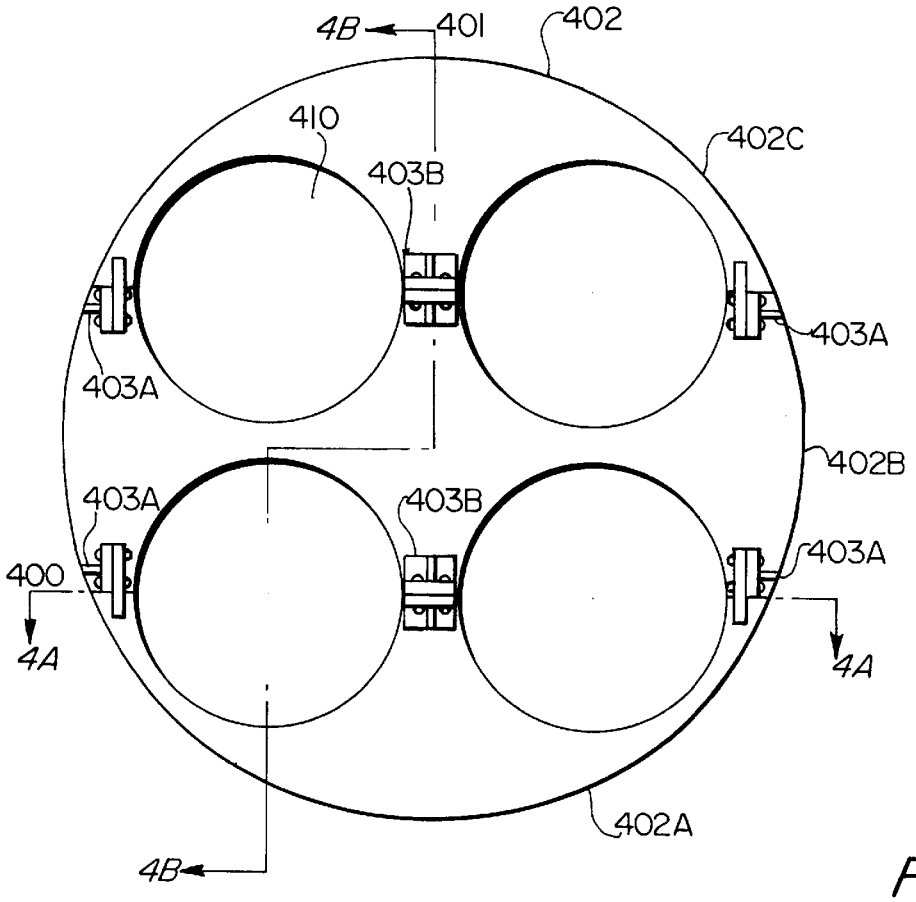
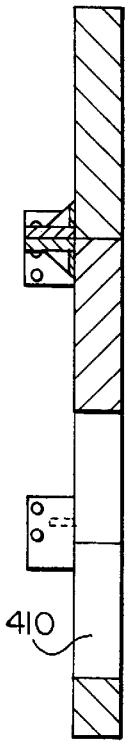
FIG. 4B
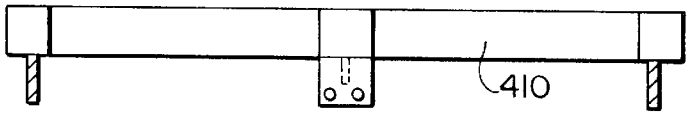
FIG. 4A

FIG. 10C
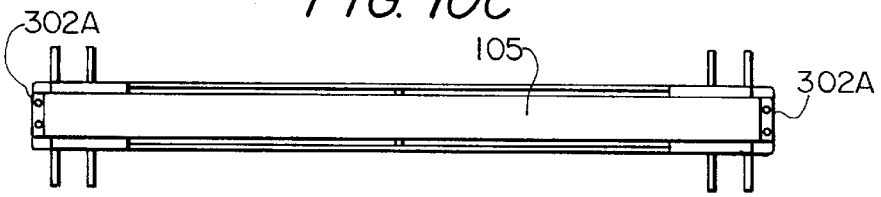
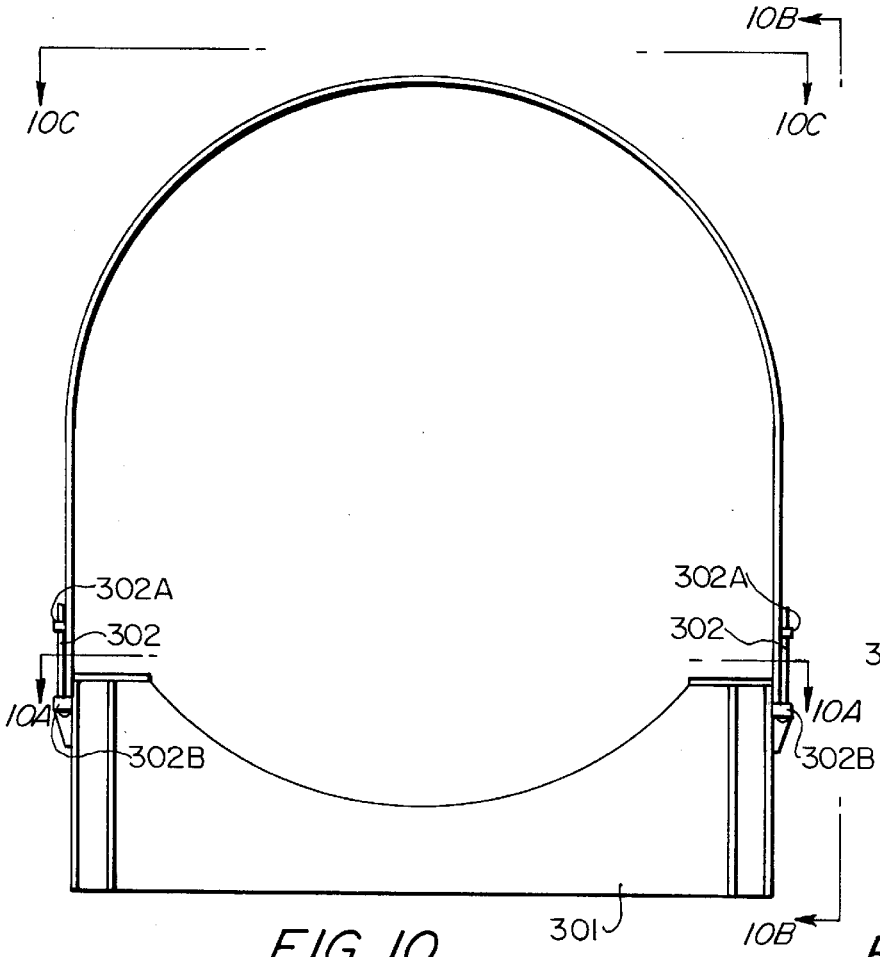
FIG. 10
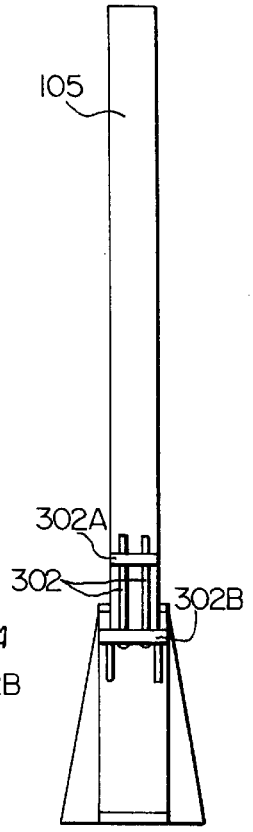
FIG. 10B
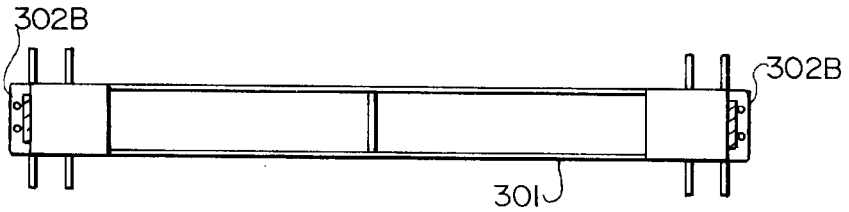
FIG. 10A

INTERMODAL MODULAR SPENT NUCLEAR FUEL TRANSPORTATION SYSTEM

This application claims the benefit of U.S. provisional application Ser. No. 60/040,358 filed Mar. 12, 1997.

FIELD OF THE INVENTION

The present invention is in the field of handling and transportation of spent nuclear fuel and other hazardous materials. In particular, the present invention is a system for modular handling and transportation primarily of single or multiple spent nuclear fuel (SNF) assemblies to an interim storage facility, transfer point, or final federal disposal site.

BACKGROUND OF THE INVENTION

Methods and machines for transportation and transfer of SNF and other radioactive materials are well known in the art. Nuclear reactors and storage sites for SNF and other radioactive materials have been in operation for decades and, as a consequence of their operation, generate the need to dispose of SNF and other radioactive by-products. The latter may include contaminated primary equipment and primary piping that is damaged or obsolete. Various government agencies, such as the Department of Energy, have developed guidelines for the safe handling of SNF and other nuclear by-products with personnel safety as a primary concern. Secondary concerns addressed by regulation relate to spill avoidance and containment which protects against long term environmental contamination and accompanying risks to human and animal health.

Increasingly strict regulations, in conjunction with the increasing demand for nuclear power and products, provide the impetus for improvements in the safe handling and transportation of radioactive materials. Any operation involving the handling of SNF or other radioactive materials may involve special procedures because of the threat of leakage of radioactive materials. SNF, though depleted for fuel purposes, emits high amounts of radiation known to be damaging to living organisms including humans. To handle SNF safely, personnel must be protected from high levels of radiation by using appropriate containment vessels around SNF. To better provide for safe handling of nuclear materials, a variety of SNF handling containers using suitable shielding materials has evolved to package SNF for transport and transfer. The disadvantage of prior art methods include the lack of standardized container sizes and scalable means for handling both small and large SNF loads. Prior art methods of transporting SNF and other by-products of nuclear industry include loading SNF into either shielded casks or into canisters. Such canisters may then be placed into a shielded overpack.

A cask may be described as a "stand alone" SNF container having integral shielding, fuel basket and containment features. The disadvantage of cask-based handling systems is that the casks including their shielding must be handled as a unit or in systems designed for handling multiple casks. Such systems usually involve assembling and disassembling cask handling units into larger and smaller units as they progress through their distribution and disposal route. Such assembly or disassembly is time consuming and laborious, requiring special equipment.

A canister may be described as an unshielded SNF container forming a component of a fuel storage and a fuel transportation system. A canister, once loaded with SNF, may be stored within a shielded container or overpack forming the chief component of a larger storage and transportation system. The size and capacity of both cask- and canister-based systems may vary. Systems having one or two SNF assemblies may weigh approximately 20 tons and are suitable for truck transport. Systems with over 50 SNF assemblies may weigh over 100 tons and require heavy-mode or heavy-haul transport. Cranes are typically used in such systems to place casks or canisters, already placed within overpacks, onto a truck trailer, rail car or heavy-haul transporter. The disadvantage of typical prior art cask and canister systems is the non-uniform size of the casks and canisters and the inability to easily transfer casks and canisters from a transport means of one scale to a transport means of another scale without disassembly or the use of heavy equipment.

While competitive forces driving the SNF disposal industry make taking advantage of the "economy of scale" that higher capacity systems offer attractive, many plants and facilities lack the capability to handle larger-scale SNF transport systems. Smaller plants may, on the other hand often have a smaller budget for facility upgrades and must look to small, truck transportable systems to ship SNF to its final destination. Lack of space, lack of crane capacity, fuel pool floor loading limits and other technical limitations may restrict the use of large scale SNF transport systems for some facilities. Some nuclear power plants and other SNF storage facilities lack on-site access to rail or barge transport, and thus require heavy-haul of large cask or canister systems to the nearest rail spur or port. Heavy-haul transportation over public roads may be slow and may tie up traffic creating hazardous driving conditions. Moreover, public transportation infrastructure often requires strengthening of bridges and other costly upgrades to accommodate heavy-haul loads. Heavy-haul loads, especially with SNF payloads, may require special permits and escorting, and may not be permitted at all in some regions.

Once a cask or canister system reaches an exchange site, transfer to a new transport means may be required. Such a transfer, from a heavy-haul truck transport to a rail car or barge, for example, may often involve providing temporary crane and handling services in remote locations. This may increase the overall expense of an SNF transport evolution, expose workers and the public to increased risks associated with handling accidents, and create unnecessary delays. Furthermore, federal requirements may necessitate the transfer of large casks from rail back to heavy-haul truck for transport over large distances to federal facilities.

Accordingly, an alternate system and method of transfer and transportation of SNF using standard fuel handling methods would be welcome in the art. Such system and method for SNF transport could be employed without the use of cranes and heavy-haul equipment. An SNF transport system that would easily accommodate intermodal transfer of multiple canisters between standard transport means such as truck, rail, barge, and the like. Such a system would further allow standardization of SNF transportation equipment and allow truck sized components to be handled by nearly all SNF storage facilities.

SUMMARY OF THE INVENTION

The Intermodal Modular Spent Nuclear Fuel Transportation System of the present invention overcomes the deficiencies of prior art handling methods. The system of the present invention uses conventional truck, rail, barge or ship equipment to transport nuclear materials including SNF in standardized modules thus maximizing the interchangeability of transportation components, while minimizing overall impact and requirements for upgrades to the public transportation infrastructure. The system of the present invention does not require crane or heavy equipment to handle or transfer SNF containers. Such heavy equipment, however, may be used in the assembly of overpack bundles. The system of the present invention allows for configuration of transportation components to optimize the ratio of truck to rail standard module containers to best match the required throughput for specific shipping campaigns.

The system of the present invention includes a plurality of conventional trucks, each with a single overpack mounted to a cradle on the truck platform. The overpack thus forms the basic module of the present invention. SNF canisters may be transferred from the single truck-mounted overpack, using a winch or other movement device, to and from an empty overpack in an overpack bundle disposed within a cradle assembly further disposed on the rail car or barge. An overpack bundle comprises a plurality of overpacks clamped together. The empty overpack in the overpack bundle may be placed into position for receiving an SNF canister by axial rotation of the overpack bundle to align with the truck-mounted overpack.

To receive an SNF canister from a truck-mounted overpack, the cradle assembly may be rotated horizontally right or left to allow truck docking from a direction perpendicular to the normal orientation of the rail car. The truck-mounted overpack and the corresponding empty rail car overpack may be "docked" and an SNF canister may be transferred from the truck-mounted overpack to a corresponding overpack in the rail- or barge-mounted overpack bundle. Actual transfer may be accomplished using a pulling or pushing device or other movement device such as a winch or like means. The process may be reversed at an intermodal transfer point to load truck-mounted overpacks with SNF canisters from the corresponding overpack of the rail or barge overpack bundle using a pushing or pulling means such as a winch. Standard module exchange may occur without removing the cradle assembly and overpack bundle from the rail car or requiring the use of a crane.

The system of the present invention may further facilitate the transfer of multiple SNF canisters to the overpack bundle using indexing or rotation of the overpack bundle. The overpack bundle may be indexed axially using a chain or gear drive to allow positioning of the next receiving overpack opening to match the truck-mounted overpack opening.

The overpack bundle of the present invention is formed by coupling together a plurality of overpacks using stockade clamps. At least two clamps, at least one of which is adapted to accommodate bundle rotation are used to secure overpacks into a bundle and to provide a supporting surface and means to which a drive may be engaged. The overpack bundle is disposed upon a cradle assembly and secured with tiebands. The cradle assembly is provided with rollers that are displaced into an operative position in which the overpack bundle may be raised and supported while facilitating axial rotation and may further have a horizontal turntable. The overpack bundle is indexed or rotated, as described, about a longitudinal axis to allow one of the empty overpacks to dock with the truck-mounted overpack. The turntable may further be rotated back into line with the rail car or barge axis after overpack bundle loading is complete.

BRIEF DESCRIPTION OF THE DRAWINGS

FIG. 4 is a cross-sectional view of the stockade clamp of the present invention.

FIG. 4A is a cross sectional perspective taken at line A—A 400 in FIG. 4.

FIG. 4B is a cross sectional perspective taken at line B—B 401 in FIG. 4.

FIG. 10 is a detailed view of the tiebands and cradle assembly of the present invention.

FIG. 10A is a view of the tiebands and cradle assembly of the present invention taken along line AA in FIG. 10.

FIG. 10B is a view of the tiebands and cradle assembly of the present invention taken along line BB in FIG. 10.

FIG. 10C is a view of the tiebands and cradle assembly of the present invention taken along line CC in FIG. 10.

DETAILED DESCRIPTION OF THE INVENTION

Figure 1:
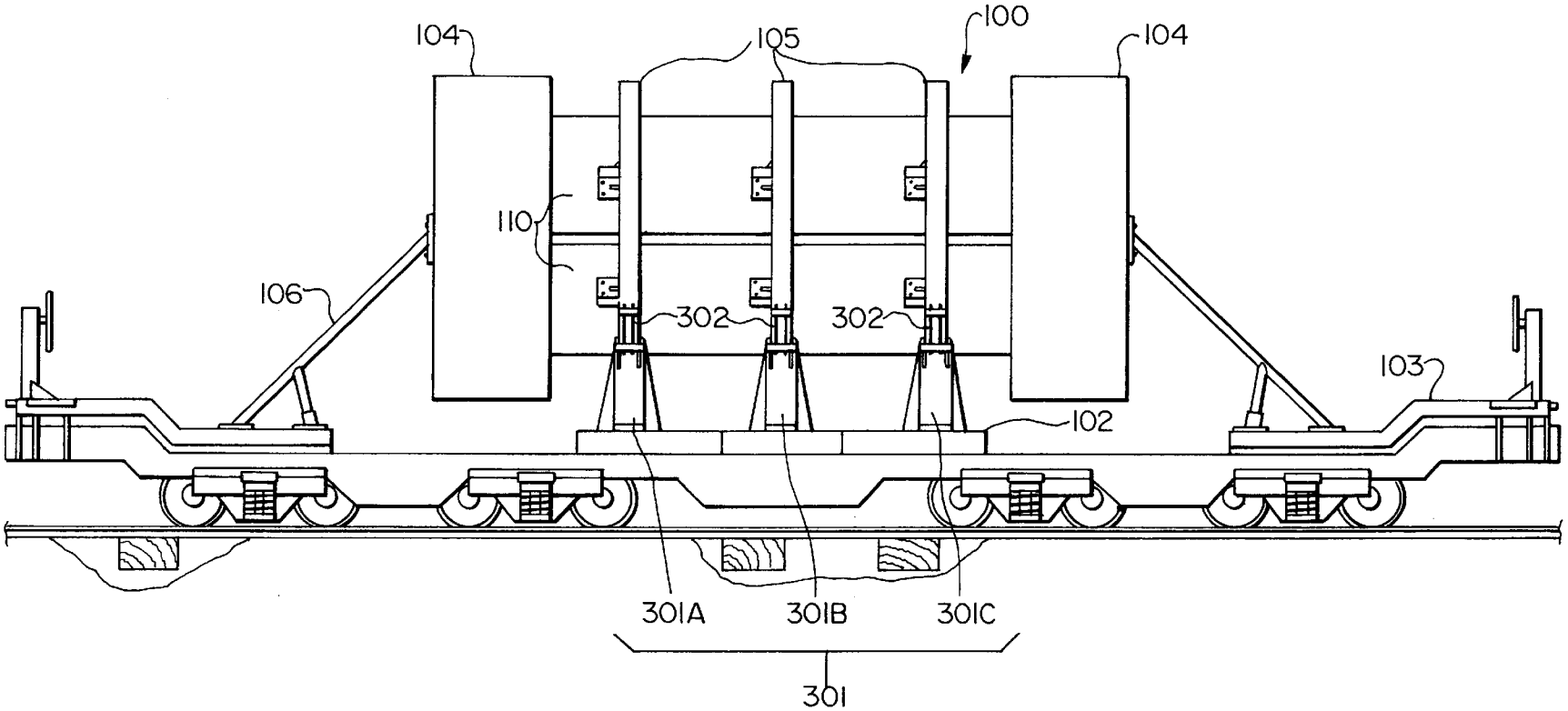
FIG. 1 is a side elevation view of the overpack bundle of the present invention on a rail car.

A portion of the Intermodal Modular Spent Nuclear Fuel Transportation System of the present invention as disposed on a transportation means which may include, in the preferred embodiment, rail car 103 is best shown in FIG. 1 ready for transporting nuclear material. The transportation means of the present invention could further include a barge or other form of heavy haul means as previously described. The present invention includes overpack 110—a special container adapted to contain spent nuclear fuel or other nuclear or hazardous material (shown in FIG. 13 as SNF canister 1300.) Overpack 110 is capable of being carried on a standard highway vehicle such as a tractor trailer truck.

Figure 12:
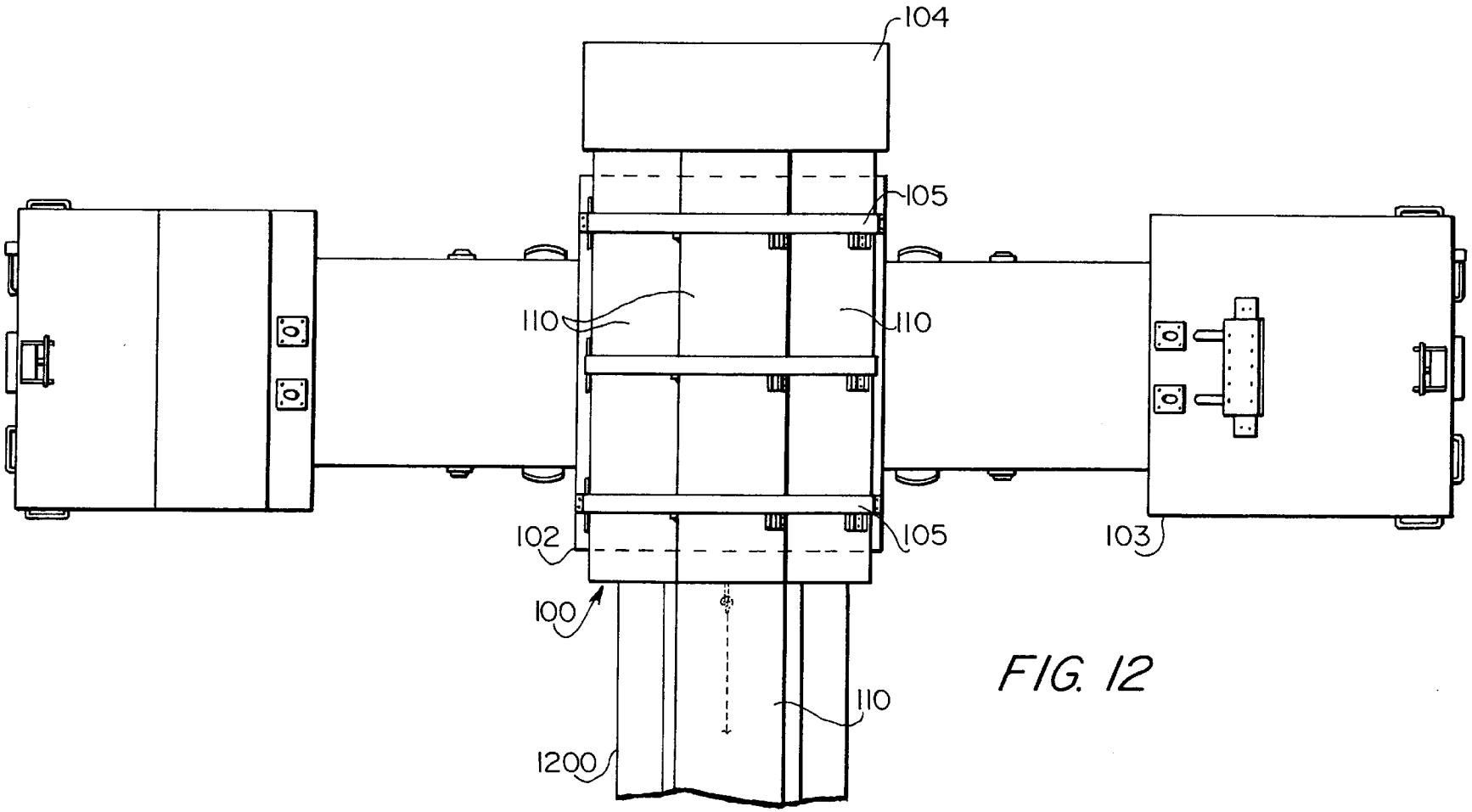
FIG. 12 is a plan view showing the overpack bundle docking with a truck-mounted overpack of the present invention.
Figure 13:
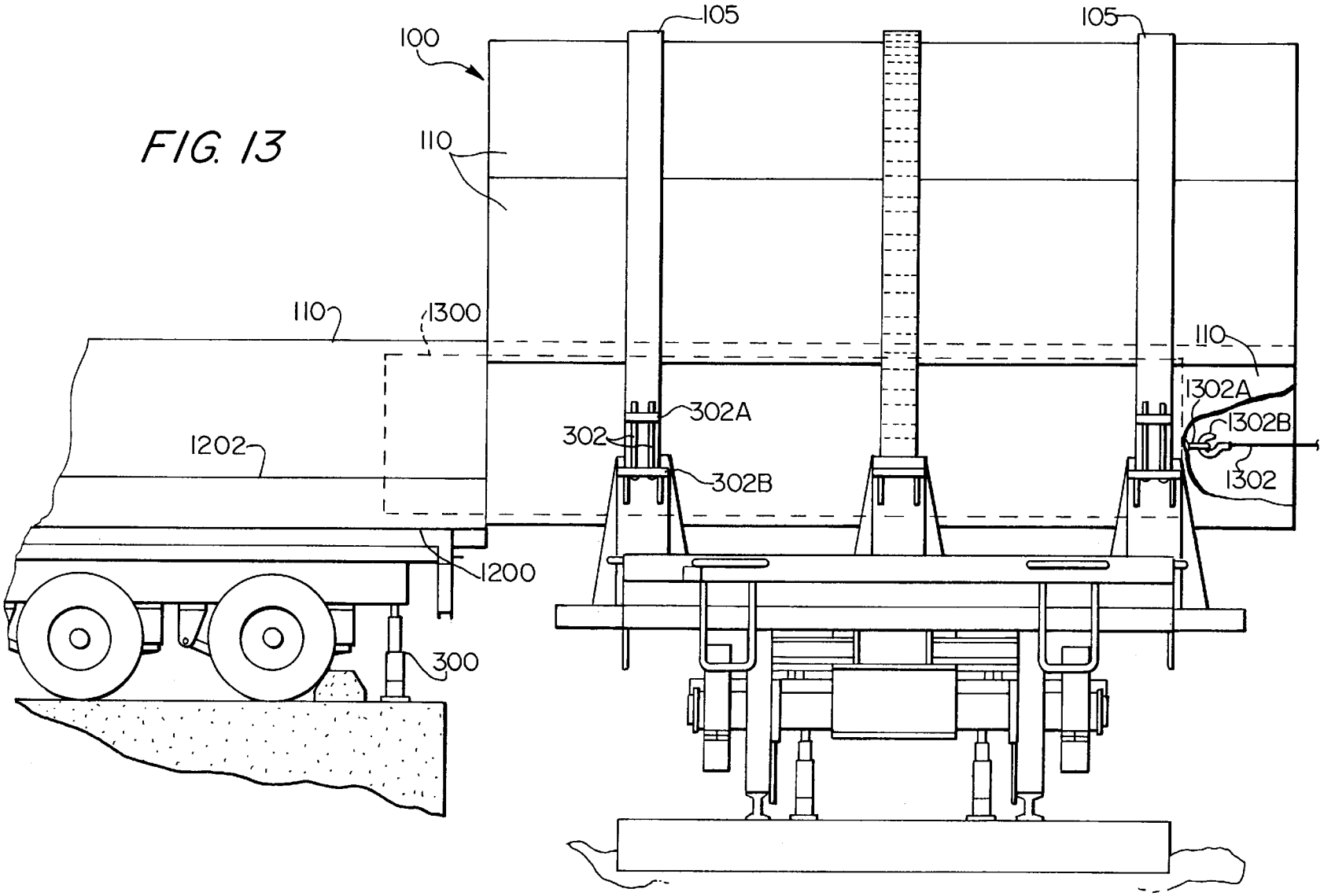
FIG. 13 is an elevation view of the transfer of a SNF canister from a truck-mounted overpack into the overpack bundle of the present invention.
Figure 14:
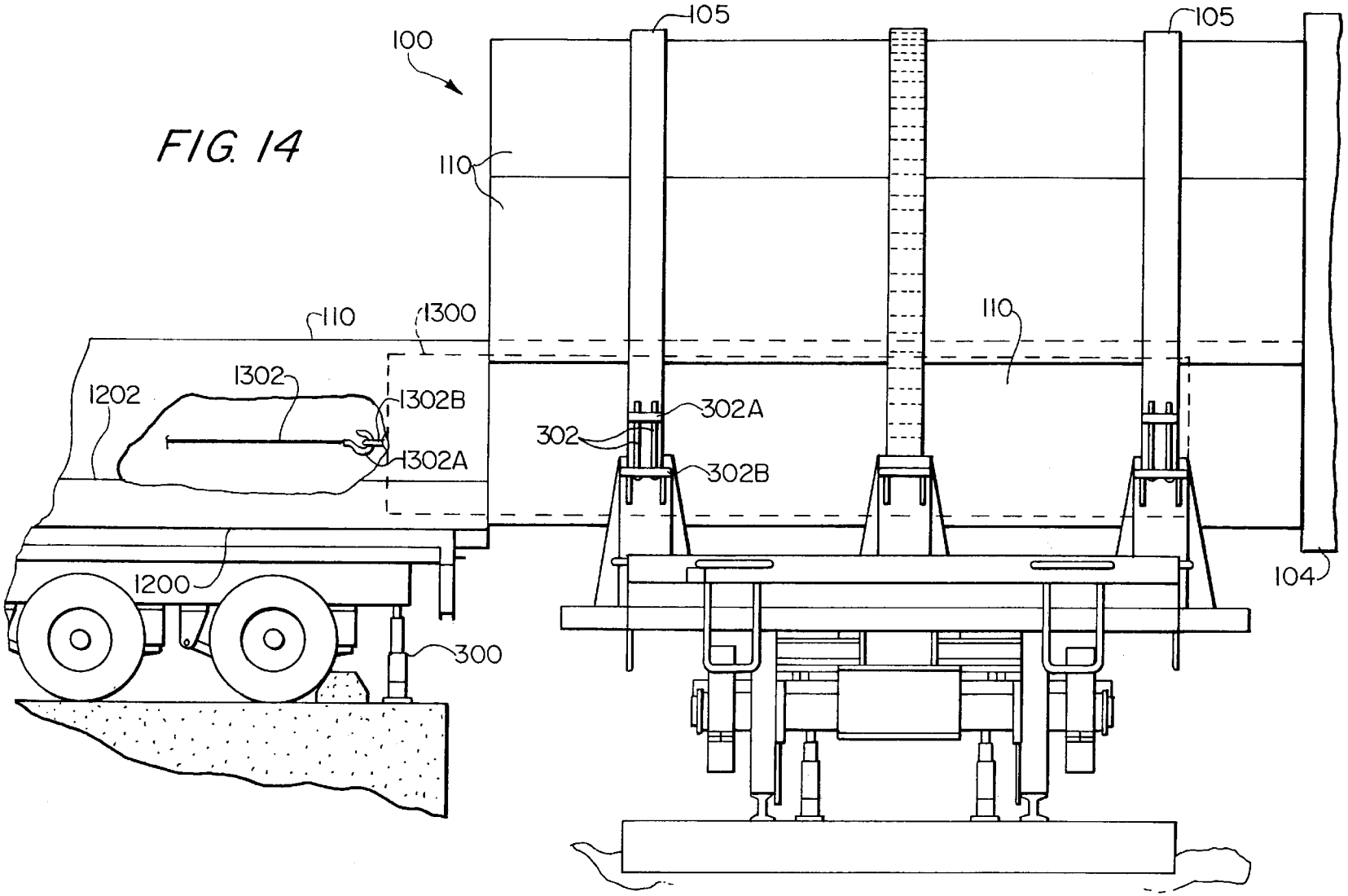
FIG. 14 is an elevation view of the transfer of a SNF canister from the overpack bundle into the truck-mounted overpack of the present invention.

Large numbers of overpacks 110 may be built to a standard design and are interchangeable between deployment in single truck-mounted configurations and heavy-haul bundles. Overpack 110 thus forms the basic module of the invention. FIGS. 12 through 14 show overpack 110 mounted on a standard tractor trailer truck 1200.

A plurality of overpacks 110 are assembled into overpack bundle 100 mounted on rail car 103 which is capable of being rotated about a longitudinal axis so that each overpack 110 can be loaded and unloaded with SNF canisters 1300 and the like. To facilitate loading and unloading, the entire assembly may be rotated in a horizontal plane about a central vertical axis so that loading can take place between one overpack 110 in overpack bundle 100 and a single overpack 110 mounted, for example, on truck 1200 approaching from the side as shown in FIGS. 12 through 14.

Figure 2:
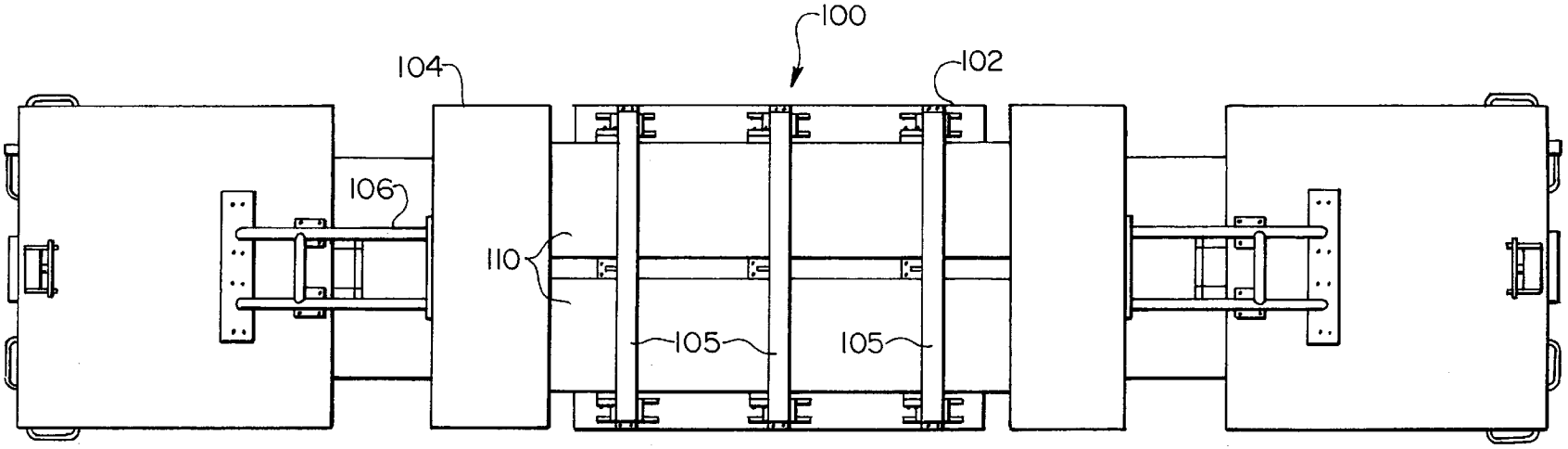
FIG. 2 is a plan view of the overpack bundle of the present invention on a rail car.
Figure 3:
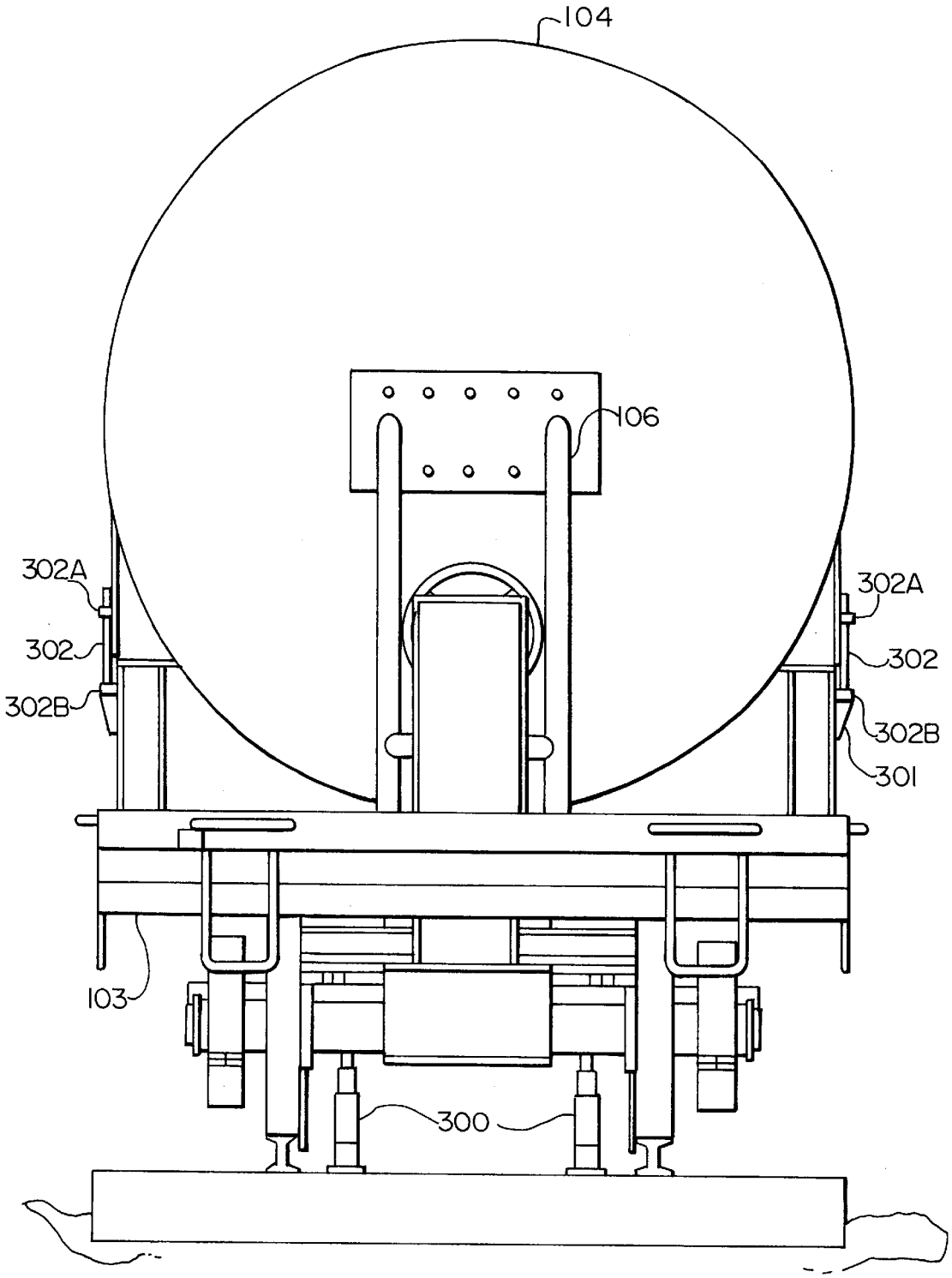
FIG. 3 is an end elevation view of the overpack bundle of the present invention on a rail car.

Overpack bundle 100 of the present invention comprises four overpacks 110 and is best shown in FIGS. 1, 2 and 3 as being aligned with the longitudinal axis of rail car 103. Overpack bundle 100 sits in cradle assembly 301 upon individual cradle sections 301A, 301B and 301C curved in such a shape to accept the generally cylindrical cross section of bundle 100. Impact limiters 104 are placed at each end of bundle 100 and are used in conjunction with impact limiter supports 106 to secure bundle 100 from longitudinal displacement. Bundle 100 is further secured to cradle sections 301A, 301B, and 301C using tiebands 105. Tiebands 105 comprise solid or partially flexible metal straps extending over bundle 100 accommodating bundle 100's generally cylindrical cross section and attaching to cradle sections 301A, 301B, and 301C using bolts 302.

Overpacks 110 are formed into overpack bundle 100 by means of a series of stockade clamps 402 (shown in FIG. 4) which provide secure clamping and corresponding structural definition to overpack bundle 100. Stockade clamps 402 are distributed at points along bundle 100 and lie in planes perpendicular to the longitudinal axis of bundle 100. Stockade clamps 402 encircle overpacks 110 to form overpack bundle 100. Stockade clamps 402 are shown in detail in FIG. 4 and also shown in FIGS. 7 and 8. Stockade clamps 402 each comprise three sections 402A, 402B, and 402C which are stacked together and bolted at vertical brackets 403A and horizontal brackets 403B as shown in views A—A and B—B of FIGS. 4A and 4B respectively. Openings 410 shown in FIGS. 4, 4A and 4B accommodate overpacks 110. Stockade clamps 402 sections 402A, 402B, and 402C bolt together securely clamping overpacks 110 rigidly in place and provide structural support for overpack bundle 100.

While openings 410 are shown as cylindrical in shape and four in number, more or fewer openings of various shapes are possible provided that the load limitation of the heavy mode transport is not exceeded and other size and weight considerations associated with carrying more than four overpacks are taken into account. To provide structural support, more than one stockade clamp 402 must be used and, in the preferred embodiment, two stockade clamps 402 are used in conjunction with a geared stockade clamp 502 as shown in detail in FIG. 5.

Figure 5:
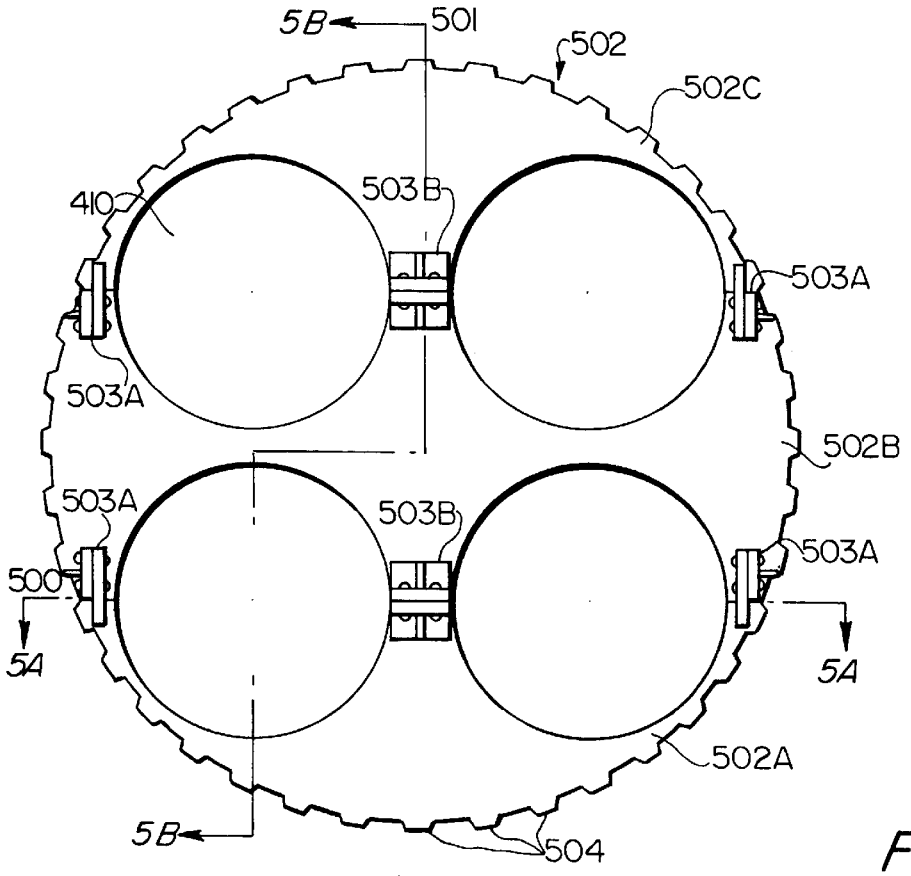
FIG. 5 is a cross-sectional view of the geared stockade clamp of the present invention.
Figure 5B:
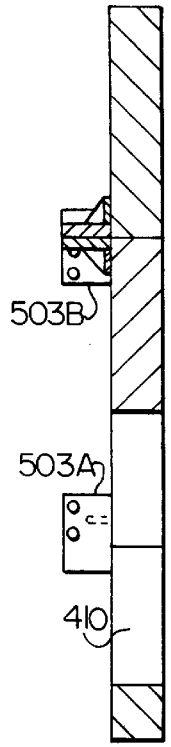
FIG. 5B is a cross sectional perspective taken at line B—B 501 in FIG. 5.
Figure 5A:
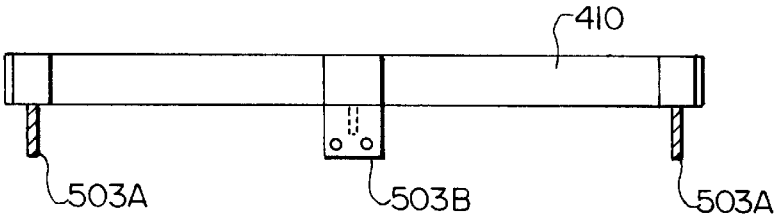
FIG. 5A is a cross sectional perspective taken at line A—A 500 in FIG. 5.

Geared stockade clamp 502 operates identically to stockade clamps 402 for securing overpacks 110. Geared stockade clamp 502 comprises three sections 502A, 502B, and 502C which are stacked together and bolted at vertical brackets 503A and horizontal brackets 503B as shown in views A—A and B—B of FIGS. 5A and 5B respectively. Openings 410 shown in FIGS. 5, 5A and 5B are sized to accommodate overpacks 110. Geared stockade clamp 502, unlike stockade clamps 402, is further provided with gear teeth 504 or alternatively sprocket teeth to engage a chain, toothed belt or drive gear connected to a drive such as drive 900 shown in FIG. 9 and described hereinafter. Such a configuration of geared stockade clamp 502 and drive 900 allows for axial rotation of overpack bundle 100.

Figure 6:
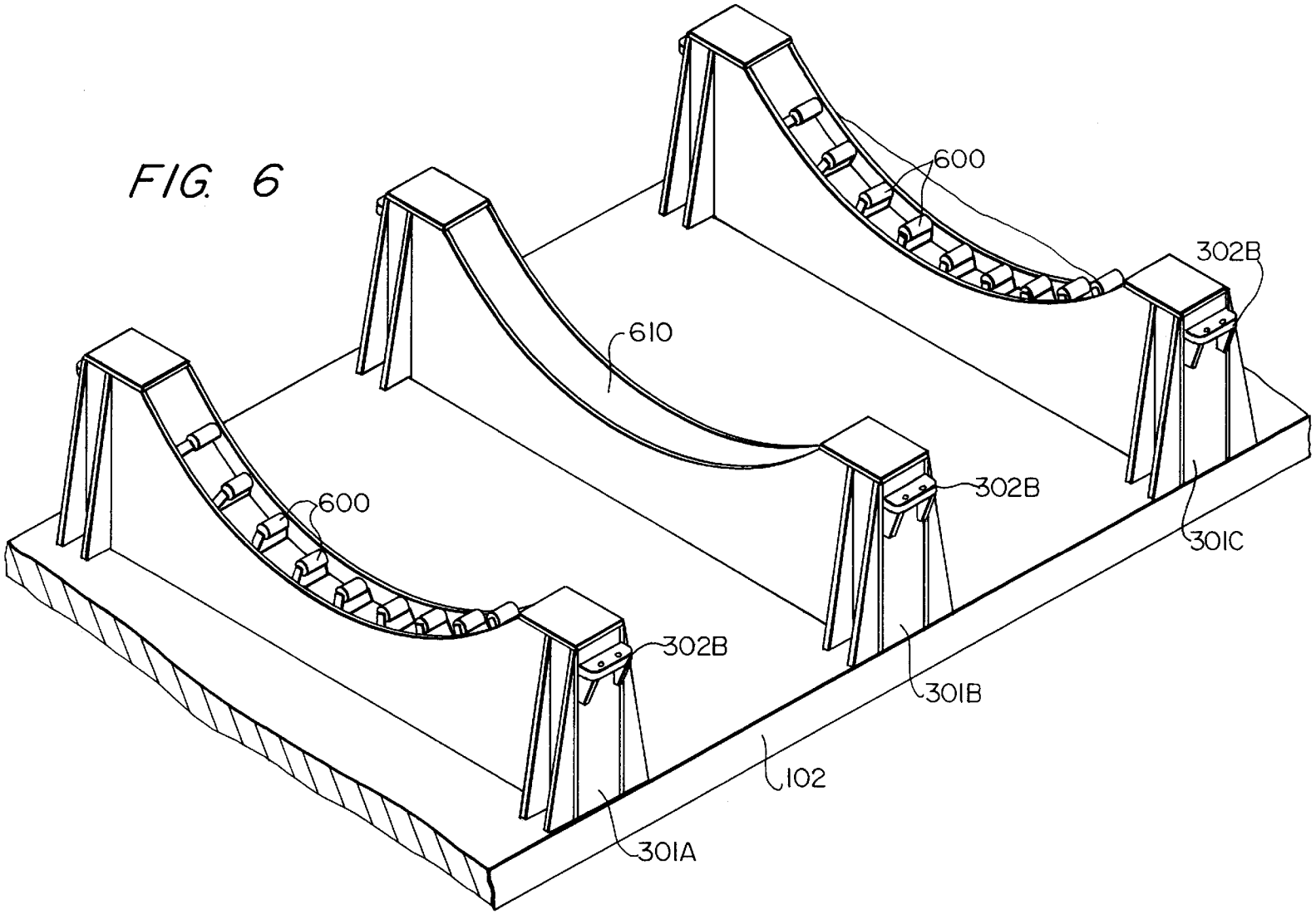
FIG. 6 is a perspective view of the cradle assembly of the present invention.
Figure 6A:
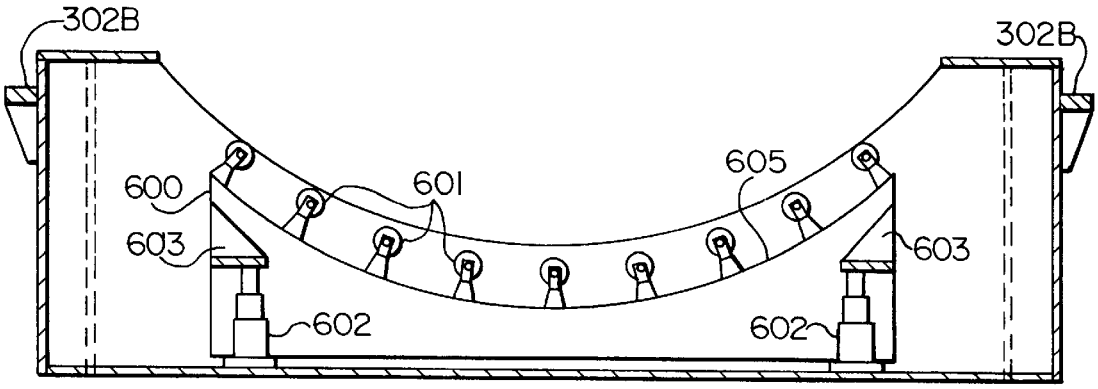
FIG. 6A is a detailed cross sectional view of the roller assembly of the present invention disposed within the cradle assembly shown in FIG. 6.
Figure 7:
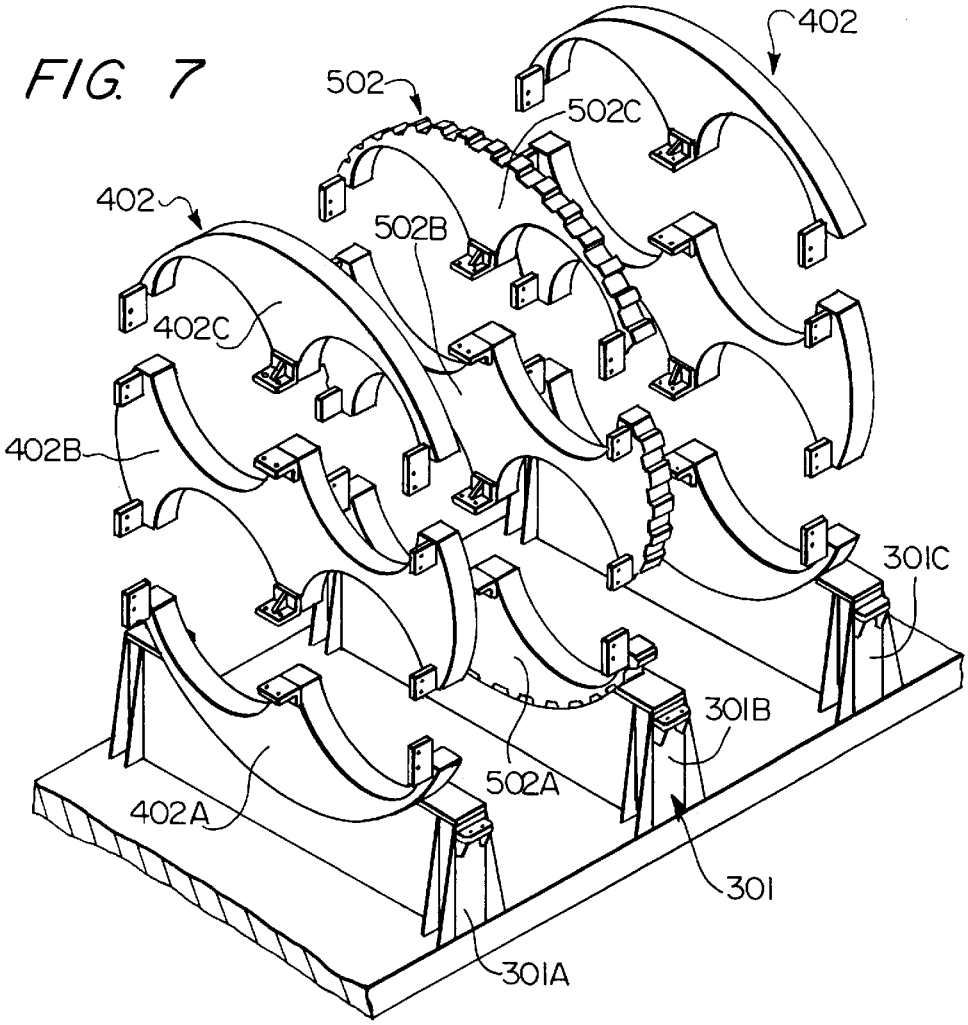
FIG. 7 is a perspective view of the cradle assembly with an exploded view of the stockade clamps and geared stockade clamp of the present invention.
Figure 8:
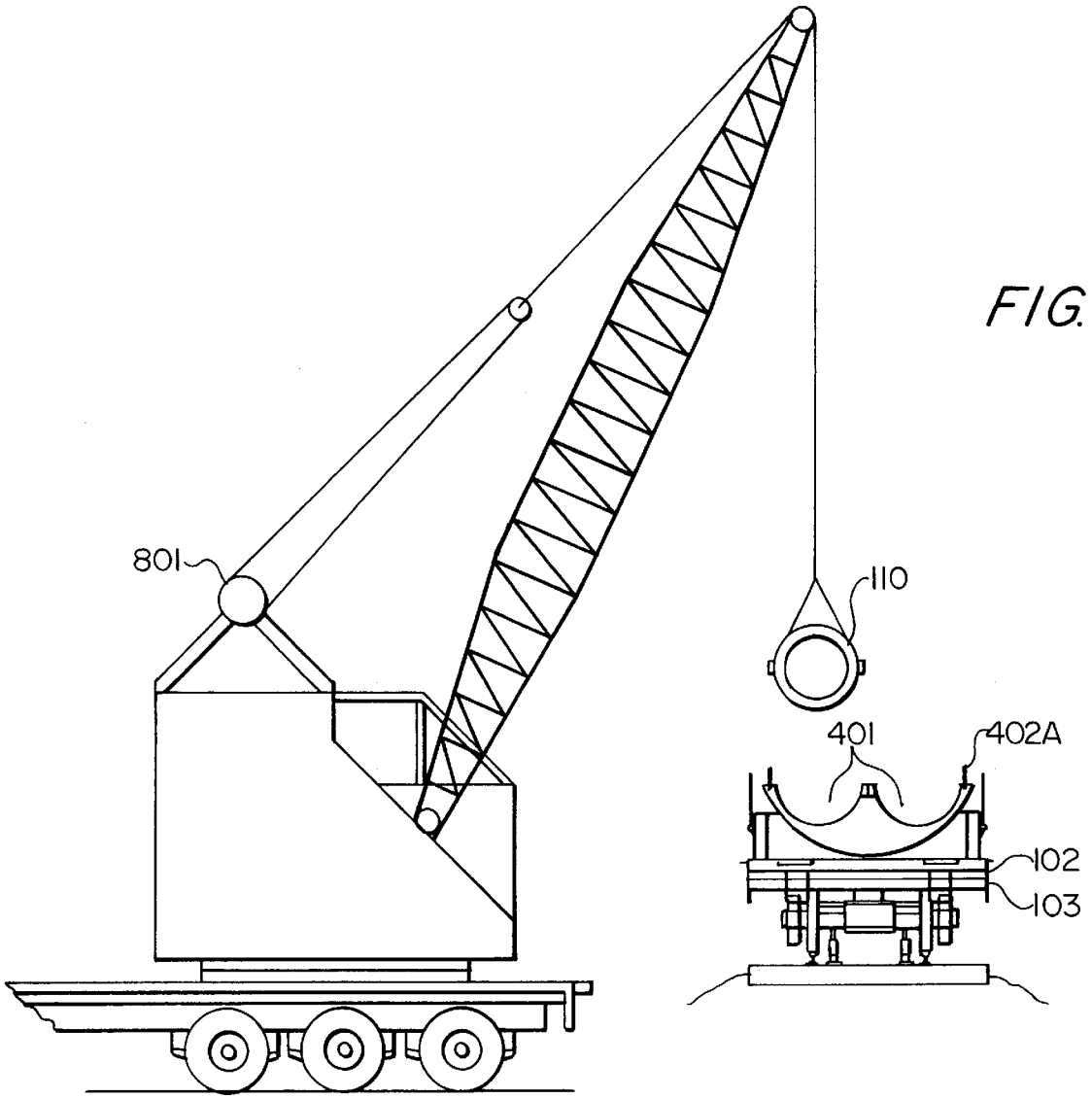
FIG. 8 is an elevation view during the assembly of module containers and stockade clamps of the present invention.

Referring now to FIG. 6 of the drawings, cradle sections 301A, 301B, and 301C are shown in more detail highlighting additional elements. Roller assemblies 600 and open section 610 greatly facilitate axial rotation of overpack bundle 100 by providing a lifting and rolling function in the case of roller assemblies 600 and by accommodating operative elements of drive 900 described hereinafter in the case of open section 610. Roller assemblies 600, during transport, are normally recessed within cradle sections 301A and 301C. Noting the alignment of cradle sections 301A and 301C with stockade clamps 402 as also shown in FIG. 7, roller assemblies 600 may be brought into engagement with the smooth surfaces of stockade clamps 402 of overpack bundle 100 to facilitate axial rotation. FIG. 6A of the drawings shows roller assemblies 600 in position for engaging and lifting smooth surfaced stockade clamps 402 (not shown in FIG. 6A) by way of a series of individual rollers 601 placed at regular intervals along the curved surface 605 of roller assembly 600. Load bearing brackets 603 placed at each end of roller assembly 600 provide contact surfaces for jacks 602, which may be hydraulic or mechanical jacks, capable of lifting and supporting overpack bundle 100 slightly off of supporting cradle sections 301A, 301B, and 301C, allowing indexed rotation of overpack bundle 100 by providing a low friction surface upon which overpack bundle 100, by way of stockade clamps 402, may freely roll.

An exploded view of two stockade clamps 402 and geared stockade clamp 502 is shown in FIG. 7. FIG. 7 illustrates the three dimensional relationship not only between individual sections of stockade clamps 402 and geared stockade clamp 502, but individual cradle sections 301A, 301B, and 301C of cradle assembly 301. Stockade clamps 402 are shown in alignment with cradle sections 301A and 301C for providing maximum load support of overpack bundle 100 and for providing a smooth surface for rollers 601, not shown in FIG. 7, to engage and support overpack bundle 100 in lifting relation. Geared stockade clamp 502 is shown in FIG. 7 as being in alignment with cradle section 301B. Open section 610, not shown in FIG. 7, sits beneath geared stockade clamp 502 and allows the operative means of drive 900 to engage teeth 504 from below. The exploded view provided in FIG. 7 further illustrates the relation of elements for the purpose of assembling overpack bundle 100.

Overpack bundle 100 is assembled in sections starting from the bottom. Assembly may be performed with base sections 402A and 502A of stockade clamps 402 and geared stockade clamp 502 respectively resting upon cradle assembly 301 as it rests on turntable 102 and rail car 103 as partially illustrated in FIG. 7 but best shown in FIGS. 8 and 9. An overpack 110, which may be empty or full during assembly, is placed into one of two openings 410 of stockade clamp base sections 402A and 502A (obstructed in this view) during the construction of overpack bundle 100 using crane 801 which may be any type of conventional crane. A second empty overpack 110 is placed in the second of two openings 410 to complete the first layer in overpack bundle 100. Next, stockade clamp middle sections 402B and 502B are placed on the top of the two overpacks 110 already in place and secured to stockade clamp base sections 402A and 502A using bolts which may be secured at vertical and horizontal brackets 403A, 503A and 403B, and 503B respectively as shown in FIGS. 4 and 5. In similar manner, two additional overpacks 110 are lifted into the two remaining openings 410 present on the upper portion of stockade clamp middle sections 402B and 502B.

When empty overpacks 110 are in place, stockade clamp top sections 402C and 502C are lifted into place and secured to the top of stockade clamp middle sections 402B and 502B accordingly using bolts at the second set of vertical and horizontal brackets 403A, 503A and 403B, and 503B respectively.

As an alternative to assembly of overpack bundle 100 upon intermodal transport means such as rail car 103, crane 801 may be used to move overpack bundle 100 in its entirety between heavy-haul means such as from rail car 103 to a barge or heavy-haul ground transport.

Figure 9:
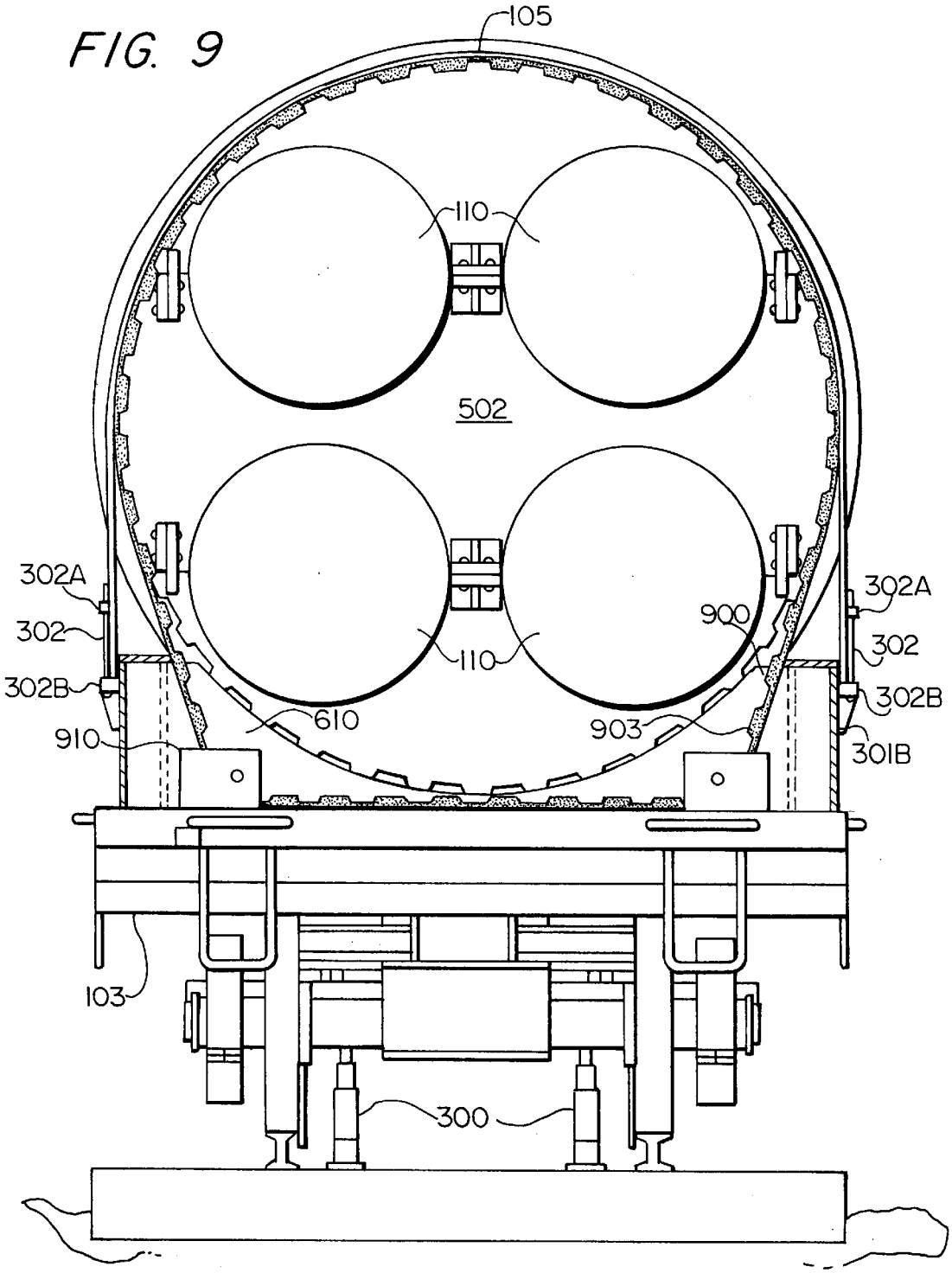
FIG. 9 is a cross-sectional view of the overpack bundle of the present invention disposed on a rail car.

During construction of overpack bundle 100 as described, geared stockade clamp 502 is placed in the center of overpack bundle 100 for the purpose of engaging a drive. Teeth 504 engage a chain, a belt or a gear drive to rotate overpack bundle 100 about its longitudinal axis. In the preferred embodiment, a drive such as chain drive 900 using drive motors 901 is used to index overpack bundle 100 between positions accommodating the loading of empty overpacks 110 and is best shown in FIG. 9. Chain 903 may be positioned within open section 610 (FIG. 6) of cradle section 301B during assembly in preparation for placement of geared stockade clamp base section 502A. Once top section 502C of geared stockade clamp 502 is installed, chain 903 is wrapped around geared stockade clamp 502 and the ends of chain 903 are linked together. Chain drive 900, as previously described, may now be used to rotationally index overpack bundle 100 between positions accommodating the loading of SNF canister 1300 from a truck-mounted overpack as is hereinafter described and illustrated in FIG. 13.

Referring again to FIG. 9, chain drive 900 engages geared stockade clamp 502 around a substantial portion of its circumference requiring clearance within cradle section 301B necessitating that the construction of cradle section 301B include open section 610 (FIG. 6) if drive means is to be incorporated therein. It is possible however, in an alternative embodiment, to locate the drive means separately from a cradle section allowing cradle section to be of conventional construction. It is further possible in an alternative embodiment for the drive means to be incorporated in a manner which does not necessitate an open top construction, but rather requires a partially open top or an opening on the side of a cradle section.

Just as roller assemblies 600 and supporting mechanisms are recessed within cradle sections 301A and 301C, chain drive 900 and its mechanisms including motors 901 are disposed within cradle section 301B.

Tiebands 105 are further shown with particularity in FIG. 10. To secure overpack bundle 100 upon cradle assembly 301, tiebands 105 are bolted in place to cradle sections 301A, 301B, and 301C. FIG. 10A shows the top of cradle 301. FIGS. 10B and 10C show side and top views of tiebands 105 respectively and show flange 302A welded to tiebands 105. FIG. 10B shows the side of cradle 301 including bolts 302, flanges 302A and 302B, and tiebands 105. Flanges 302B are welded to cradle sections 301A, 301B, and 301C. Bolts 302 connect flanges 302A and 302B to secure overpack bundle 100 to cradle 301. Bolts 302 are tightened or loosened which in turn increases or reduces the tension on tiebands 105 depending on whether indexing is required of overpack bundle 100. Prior to indexing however, overpack bundle 100 may be rotated 90 degrees or more or less on turntable 102 to accommodate loading of a single SNF canister 1300 from a overpack 110 mounted to truck 1200 on cradle 1202 as is shown in FIGS. 11–14. Truck 1200 may approach overpack bundle 100 from a direction in longitudinal alignment therewith when bundle 100 is rotated 90 degrees as described. Rotating bundle 100 in such a manner provides a more convenient loading angle.

To transfer SNF canister 1300 back and forth between overpack 110 resting in truck-mounted cradle 1202 and one of the empty overpacks 110 of overpack bundle 100 within the system of the present invention, overpack bundle 100 must be properly oriented to conduct the transfer operation. The transfer operation is carried out on the preferred embodiment of the present invention as mounted on rail car 103. The preferred embodiment of the present invention incorporated as a barge mounted system may operate in a similar manner using a pier as a perpendicular transfer point.

Figure 11:
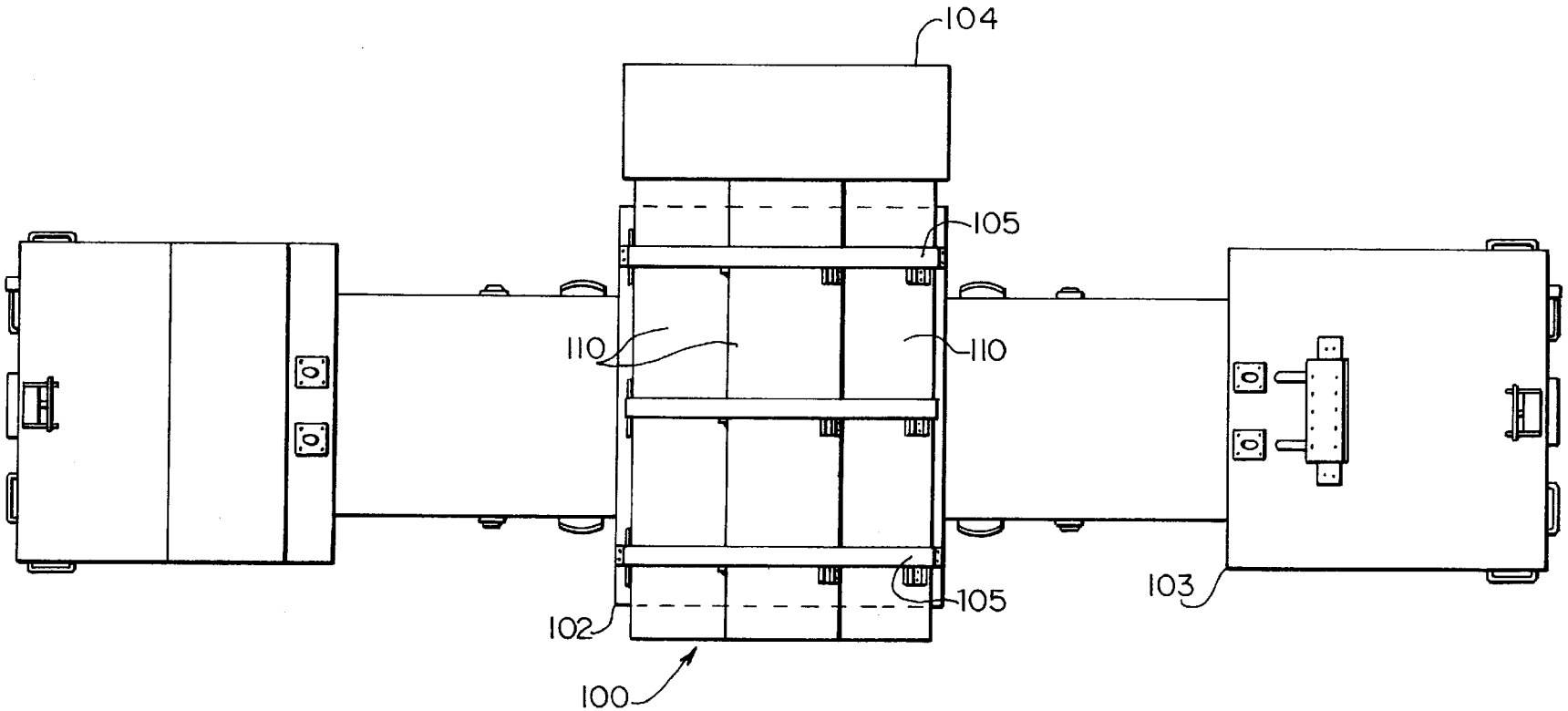
FIG. 11 is a plan view showing the overpack bundle of the present invention mounted on a rail car and rotated on turntable into docking position.

At the intermodal transfer site, rail car 103 is chocked and jacked using rail car jacks 300 as shown in FIGS. 3, 13 and 14. Impact limiters 104 and impact limiter supports 106 for restraining overpack bundle 100 from longitudinal movement are retracted and impact limiter 104 on the receiving end of overpack bundle 100 is removed completely to accommodate loading as best shown in FIGS. 11–14. Turntable 102 mounted on rail car 103, supporting overpack bundle 100 may be rotated by use of a gear drive, hydraulic drive, or by pushing or pulling means. FIGS. 11 and 12 show turntable 102 rotated 90°. Once turntable 102 has been rotated to the 90° loading position, tiebands 105 may be loosened, as described, and roller assemblies 600, disposed within cradle sections 301A and 301C, may be raised using jacks 602. Overpack bundle 100 is thereby supported by rollers 601 allowing and facilitating axial rotation as previously described. Finally, chain drive 900, or like drive means, may be tensioned or engaged for facilitating axial indexing of overpack bundle 100 to position overpacks 110 for loading or unloading to or from truck 1200 with a truck-mounted overpack 110 as further illustrated in FIG. 12.

Truck 1200 with overpack 110 mounted thereto and containing an SNF canister 1300 is moved into position such that when turntable 102 is rotated 90° or more or less, overpack bundle 100 is in alignment with overpack 110 as mounted on truck 1200. Indexing is achieved when an overpack 110 within overpack bundle 100 is rotated into alignment with overpack 110 on truck 1200 for transferring an SNF canister 1300. Indexing overpack bundle 100 may include rotating an overpack 110 from any relative upper position on overpack bundle 100 to a relative position at the bottom of overpack bundle 100. Truck-mounted overpack 110 may be aligned and docked with the indexed bundled overpack. Proper docking requires that the center of overpack 110 be in longitudinal alignment with the center of overpack 110 of overpack bundle 100 positioned for transfer of SNF canister 1300. SNF canister 1300 may be transferred from overpack 110 into the indexed overpack 110 using a conventional load transfer or movement device 1302 as further shown in FIG. 13. Movement device 1302 may include, for instance, a winch, a hydraulic system, a ram, a grapple, and the like, but is shown as a cable winch with a hook end 1302A which engages SNF canister 1300 at a corresponding eye 1302B mounted thereto.

After completing the transfer of SNF canister 1300 and while empty overpacks 110 are available in overpack bundle 100, empty truck-mounted overpack 110 may be undocked and overpack bundle 100 indexed to bring the next empty overpack 110 into position for docking with the next truck-mounted overpack 110. Indexing and loading may proceed in like manner until the remaining empty overpacks 110 within overpack bundle 100 are filled. When all overpacks 110 in overpack bundle 100 are loaded with SNF canisters 1300, roller assemblies 600 may be lowered into cradle sections 301A and 301C bringing overpack bundle 100 into supporting relation to cradle 301A, 301B, and 301C. Tie-bands 105 are tightened and turntable 102 is rotated back into longitudinal alignment with rail car 103. Impact limiters 104 are replaced and impact limiter supports 106 restored into position.

At the destination for SNF canister 1300 transfer, the loading process may be reversed and overpack bundle 100 unloaded by moving SNF canisters into truck-mounted overpack 110 as shown in FIGS. 13 and 14. FIG. 14 shows SNF canister 1300 being transferred from overpack bundle 100 into truck-mounted overpack 110 using movement device 1302 comprising a cable and hook assembly for applying a pulling force from the opposite direction.

In an alternative embodiment, the system of the present invention may be easily adapted to handle other radioactive material. Such material may include high and low level radioactive material generated during the decommissioning of contaminated sites, non-fuel assembly hardware, consolidated SNF assemblies, failed or broken fuel rods, and vitrified radioactive waste. The system of the present invention may bundle units other than overpacks 110. Other units may include SNF casks, liquid transport tanks, gas transport tanks, and the like. Similarly, stockade clamps 402, and geared stockade clamp 502 for accommodating cylindrical overpacks, may be adapted to bundle non-circular shapes such as rectangular and elliptical standard modules.

In yet another embodiment, the system of the present invention may be further adapted for general purposes to handle any material susceptible of being placed in a container designed to fit into overpacks 110 and equivalent configurations. Such material may include non-radioactive liquid commodities such as gasoline or liquid chemicals and may further include non-radioactive solid commodities such as grain, solid chemicals, and the like. Since the general purpose embodiment of the present invention is primarily for commodity transport, shielded overpacks of the kind required for handling nuclear material are generally not required. Thinner walled overpacks instead may be used. In some cases where canisters are particularly well suited for exposure to environmental elements, canisters may be transferred directly into openings 410 within clamping assemblies 401 and 501 without the need for overpacks. Alternatively, overpack bundle 100 may be assembled using pre-packed commodity canisters, the assembly operation being as previously described.

To fully exploit the improved material handling capabilities of overpack bundle 100, general purpose overpacks, containers, and trailer systems adapted for container handling are used. Tractor trailers carrying, for example, gasoline in a conventional fixed tank may instead be adapted to carry gasoline in a transferrable canister. In the general purpose embodiment, such a canister is secured to the trailer within a trailer mounted overpack and is transferred to and from overpack bundle 100 in a manner similar to the preferred embodiment.

From the foregoing detailed description, it will be evident that there are a number of changes, adaptations and modifications of the present invention which come within the province of those persons having ordinary skill in the art to which the aforementioned invention pertains. However, it is intended that all such variations not departing from the spirit of the invention be considered as within the scope thereof as limited solely by the appended claims.

We claim:

1. An intermodal modular nuclear material transport system for transporting nuclear material including spent nuclear fuel rods, nuclear vitrified waste, broken nuclear fuel rods, and contaminated material, between destinations, said destinations including nuclear waste disposal sites, nuclear power facilities, and intermodal transfer points, said transport system comprising:

at least one nuclear material canister for containing said nuclear material;

a transportation means for transporting said nuclear material;

an overpack bundle coupled to said transportation means, said overpack bundle comprising a plurality of overpacks for receiving said at least one nuclear material canister;

a cradle assembly coupled to said transportation means and said overpack bundle for supporting and facilitating rotational movement of said overpack bundle about a longitudinal axis; and a turntable coupled to said transportation means, said cradle assembly, and said overpack bundle for rotating said cradle assembly and said overpack bundle in a horizontal plane about a central vertical axis to selectively position said overpack bundle for transferring said at least one nuclear material canister into and out of one of said plurality of overpacks in said overpack bundle.

2. The transport system of claim 1 further comprising:

a first drive assembly coupled to said cradle assembly and said overpack bundle for rotating said overpack bundle about a longitudinal axis to a predetermined position; and a second drive assembly coupled to said transportation means, said cradle assembly, and said turntable for rotating said turntable in said horizontal plane by a predetermined amount.

3. The transport system of claim 2, wherein said cradle assembly further comprises:

at least one cradle section coupled to said turntable for receiving a portion of said first drive assembly; and at least two cradle sections coupled to said turntable, each of said at least two cradle sections having a roller assembly disposed therein.

4. The transport system of claim 3, wherein said roller assembly is displaceable between first and second positions, in said first position wherein said roller assembly is recessed within said each of said at least two cradle sections, said roller assembly being withdrawn from operative engagement with said overpack bundle, and in said second position wherein said roller assembly is displaced in operative engagement with said overpack bundle for facilitating the rotation of said overpack bundle upon said cradle assembly.

5. The transport system of claim 2 wherein said overpack bundle further comprises at least two overpacks secured by at least two clamping assemblies.

6. The transport system of claim 5 wherein one of said at least two clamping assemblies has teeth spaced at regular intervals therearound for engaging said first drive assembly.

7. The transport system of claim 6 wherein said at least two clamping assemblies comprise stockade clamps.

8. The transport system of claim 1, further comprising a second transportation means wherein said second transportation means comprises a highway vehicle.

9. An intermodal modular nuclear material transport system for transporting nuclear material including spent nuclear fuel rods, nuclear vitrified waste, broken nuclear fuel rods, and contaminated material, between destinations, said destinations including nuclear waste disposal sites, nuclear power facilities, and intermodal transfer points, said transport system comprising:

at least one nuclear material canister for containing said nuclear material;

at least one overpack for receiving said nuclear material canister;

a transportation means coupled to said at least one overpack for transporting said nuclear material canister received in said at least one overpack; and a turntable coupled to both said transportation means and said at least one overpack for rotating said at least one overpack in a horizontal plane about a central vertical axis.

10. The transport system of claim 9 further comprising:

a cradle assembly; and an overpack bundle coupled to said transportation means and said cradle assembly, said overpack bundle comprising a plurality of overpacks for receiving said at least one nuclear material canister in a selected one of said plurality of overpacks.

11. The transport system of claim 10 wherein said cradle assembly further comprises a first drive assembly for positioning said selected one of said plurality of overpacks into a first predetermined coupling position.

12. The transport system of claim 11 wherein said cradle assembly further comprises:

at least one cradle section coupled to said turntable for receiving a portion of said first drive assembly; and at least two cradle sections coupled to said turntable each having a roller assembly disposed therein.

13. The transport system of claim 12 wherein said roller assembly is displaceable between first and second positions, in said first position wherein said roller assembly is recessed within said at least two cradle sections and in said second position wherein said roller assembly is displaced in operative engagement with said overpack bundle for facilitating the rotation of said overpack bundle upon said cradle assembly.

14. The transport system of claim 11 wherein said overpack bundle comprises at least two clamping assemblies for securing said plurality of overpacks in said overpack bundle.

15. The transport system of claim 14 wherein at least one of said at least two clamping assemblies further comprises teeth spaced at regular intervals around an outer circumference for engaging said first drive assembly.

16. The transport system of claim 15 wherein said teeth further include gear teeth.

17. The transport system of claim 15 wherein said teeth further include chain teeth.

18. The transport system of claim 10 wherein said turntable further comprises a second drive assembly for rotating said overpack bundle in a horizontal plane about a central vertical axis for positioning said overpack bundle into a second predetermined coupling position.

19. The transport system of claim 9, further comprising a second transportation means wherein said second transportation means comprises a highway vehicle.

20. A method for providing intermodal transportation of nuclear material including spent nuclear fuel rods, nuclear vitrified waste, broken nuclear fuel rods, and contaminated material, between destinations, said destinations including nuclear waste disposal sites, nuclear power facilities, and intermodal transfer points, said method comprising:

providing a first transportation means, transporting a canister of nuclear material by said first transportation means, providing a second transportation means, providing an overpack bundle having a plurality of openings mounted on said second transportation means, rotating said overpack bundle to provide access to a predetermined opening, coupling said first transportation means to said second transportation means, and transferring said canister of nuclear material between said first transportation means and said predetermined opening.

21. The method of claim 20 wherein said step of rotating further comprises rotating said overpack bundle about a vertical axis by a predetermined amount.

22. The method of claim 20 wherein said step of rotating further comprises rotating said overpack bundle about a longitudinal axis by a predetermined amount.

23. The method of claim 22 wherein said step of rotating further comprises:

selectively supporting said overpack bundle in fixed relation to a cradle assembly to inhibit longitudinal rotation of said overpack bundle, and selectively supporting said overpack bundle in rolling relation to said cradle assembly to facilitate longitudinal rotation of said overpack bundle.

24. A general purpose intermodal material transport system for transporting material including solid, liquid, and gaseous material between a transfer source and a transfer destination including intermodal transfer points, said transport system comprising:

at least one general purpose material canister for containing said material;

at least one overpack for receiving said general purpose material canister;

a transportation means coupled to said at least one overpack for transporting said general purpose material canister received in said at least one overpack; and a turntable coupled to both said transportation means and said at least one overpack for rotating said at least one overpack in a horizontal plane about a central vertical axis.

25. The transport system of claim 24 further comprising:

a cradle assembly; and an overpack bundle coupled to said transportation means and said cradle assembly, said overpack bundle comprising a plurality of overpacks for receiving said at least one general purpose material canister in a selected one of said plurality of overpacks.

26. The transport system of claim 25 wherein said cradle assembly further comprises a first drive assembly for positioning said selected one of said plurality of overpacks into a first predetermined coupling position.

27. The transport system of claim 26 wherein said cradle assembly further comprises:

at least one cradle section coupled to said turntable for receiving a portion of said first drive assembly; and at least two cradle sections coupled to said turntable each having a roller assembly disposed therein.

28. The transport system of claim 27 wherein said roller assembly is displaceable between first and second positions, in said first position wherein said roller assembly is recessed within said at least two cradle sections and in said second position wherein said roller assembly is displaced in operative engagement with said overpack bundle for facilitating the rotation of said overpack bundle upon said cradle assembly.

29. The transport system of claim 26 wherein said overpack bundle comprises at least two clamping assemblies for securing said plurality of overpacks in said overpack bundle.

30. The transport system of claim 29 wherein at least one of said at least two clamping assemblies further comprises teeth spaced at regular intervals around an outer circumference for engaging said first drive assembly.

31. The transport system of claim 30 wherein said teeth further include gear teeth.

32. The transport system of claim 30 wherein said teeth further include chain teeth.

33. The transport system of claim 25 wherein said turntable further comprises a second drive assembly for rotating said overpack bundle in a horizontal plane about a central vertical axis for positioning said overpack bundle into a second predetermined coupling position.

34. The transport system of claim 24, further comprising a second transportation means wherein said second transportation means comprises a highway vehicle.

* * * * *